US009115489B2

(12) United States Patent
Bourdon

(10) Patent No.: US 9,115,489 B2
(45) Date of Patent: Aug. 25, 2015

(54) SYSTEM FOR ATTACHING A PANEL TO A BEARING STRUCTURE ELEMENT

(75) Inventor: Laurent Bourdon, Seynod (FR)

(73) Assignee: Techniwood International, Maxeville (FR)

( * ) Notice: Subject to any disclaimer, the term of this patent is extended or adjusted under 35 U.S.C. 154(b) by 0 days.

(21) Appl. No.: 14/377,093

(22) PCT Filed: Apr. 16, 2012

(86) PCT No.: PCT/FR2012/050830

§ 371 (c)(1),
(2), (4) Date: Oct. 7, 2014

(87) PCT Pub. No.: WO2013/117825

PCT Pub. Date: Aug. 15, 2013

(65) Prior Publication Data

US 2015/0068153 A1 Mar. 12, 2015

(30) Foreign Application Priority Data

Feb. 7, 2012 (FR) ..... 12 51118

(51) Int. Cl.

| | |
|---|---|
| ***E04F 13/28*** | (2006.01) |
| ***E04B 1/36*** | (2006.01) |
| ***E04B 2/90*** | (2006.01) |
| ***E04F 13/23*** | (2006.01) |

(Continued)

(52) U.S. Cl.

CPC ... *E04B 1/36* (2013.01); *E04B 2/90* (2013.01); *E04F 13/23* (2013.01); *E04F 13/28* (2013.01); *E04B 1/10* (2013.01); *E04B 2001/405* (2013.01)

(58) Field of Classification Search

CPC ..... E04F 13/0855; E04F 13/0801; E04F 13/0846; E04F 13/0892; E04F 13/28; E04F 13/23; E04B 1/4178; E04B 1/41; E04B 1/36; E04B 1/10; E04B 2/90; E04B 2001/405

USPC ..... 52/702, 714, 378, 379, 506.05; 403/348, 353, 360, 383

See application file for complete search history.

(56) References Cited

U.S. PATENT DOCUMENTS

| | | | | |
|---|---|---|---|---|
| 2,843,234 A * | 7/1958 | Eckel | ..... | 52/459 |
| 2,853,870 A * | 9/1958 | Sinner et al. | ..... | 52/378 |
| 3,685,228 A * | 8/1972 | Pauley | ..... | 52/506.05 |

(Continued)

FOREIGN PATENT DOCUMENTS

| | | | |
|---|---|---|---|
| DE | 3436491 | A1 | 4/1986 |
| FR | 2940376 | A1 | 6/2010 |
| WO | 2007031240 | A1 | 3/2007 |

*Primary Examiner* — Elizabeth A Plummer
*Assistant Examiner* — Kyle Walraed-Sullivan
(74) *Attorney, Agent, or Firm* — Andrew W. Chu; Craft Chu PLLC

(57) ABSTRACT

The system for fixing a panel to an edge of an element of a supporting structure includes a clip having a shoe with a U-shaped cross-section and a first sidewall connected by a hinge-plate to a second sidewall. There is a connecting part having a flat part and a substantially cylindrically shaped stud extending perpendicular to a main plane of the flat part. The stud includes a first end fastened to a bottom face of the flat part and a head fastened to a second end of the stud. The head can have a rectangular, oval or elongate cross-section. A small dimension of the cross-section of the head is smaller than a width of the slot of the clip, and a large dimension of the cross-section of the head is larger than the width of the slot of the clip.

11 Claims, 2 Drawing Sheets

(51) Int. Cl.
*E04B 1/10* (2006.01)
*E04B 1/38* (2006.01)

(56) References Cited

U.S. PATENT DOCUMENTS 3,715,850 A * 2/1973 Chambers ..... 52/701
4,073,108 A * 2/1978 Williams ..... 52/238.1
4,221,095 A * 9/1980 Weinar ..... 52/489.2
4,523,413 A * 6/1985 Koppenberg ..... 52/139
4,765,108 A 8/1988 Lapish
5,283,992 A * 2/1994 Morassutti ..... 52/509
5,823,700 A * 10/1998 Poworoznek ..... 403/245
5,953,865 A * 9/1999 Rickards ..... 52/139
5,966,893 A * 10/1999 Quillin ..... 52/713
6,047,515 A * 4/2000 Behlen ..... 52/699
8,607,515 B2 * 12/2013 Jarvis ..... 52/253
8,720,031 B2 * 5/2014 Sauer ..... 29/428
8,875,467 B2 * 11/2014 Anastasi ..... 52/705
2004/0084589 A1 * 5/2004 Berardi ..... 248/298.1
2004/0187400 A1 * 9/2004 Anderson et al. ..... 52/79.1
2006/0260243 A1 * 11/2006 Angelozzi, Jr. ..... 52/506.05
2010/0229488 A1 * 9/2010 Cristina ..... 52/489.1
2012/0017530 A1 * 1/2012 Hummel, III ..... 52/506.05
2012/0102710 A1 * 5/2012 Sauer ..... 29/428

* cited by examiner

SYSTEM FOR ATTACHING A PANEL TO A BEARING STRUCTURE ELEMENT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The invention relates to a system for fixing a panel to an edge of an element of a supporting structure, element such as a beam or a slab.

2. Description of Related Art Including Information Disclosed Under 37 CFR 1.97 and 37 CFR 1.98

It is known to construct buildings comprising a supporting inner structure of concrete, steel or wood, and panels closing the free outer gaps between the elements of the structure. The panels have for example a height substantially equal to a height of a floor of the building, and are rigidly fixed, for example at the bottom to the edge of a floor slab and at the top to the edge of a ceiling slab.

Quick fastening systems have been developed in order to facilitate the fastening of the panel to the structure. These systems are generally based on flat metal parts suitably folded and secured by screwing, on the one hand, to the panel and, on the other hand, to the element of the structure.

In practice it is observed that an element of the structure, for example a beam or slab, may be deformed depending on the operating load applied to the said element. For example, the laying of floor tiles or the placing of furniture on a concrete slab can result into a vertical bending of the slab, which bending can reach 1 to 1.5 cm at the edge of the slab in the case of a concrete slab. This bending of the slab will cause disorders and/or transmit mechanical stresses onto the panels of the lower or higher floors, rigidly fastened to the edges of the slabs, with the risk of damaging one or more panels.

Also an earthquake-like seism can cause a significant horizontal displacement of a slab with respect to another one. If a panel is fixedly fastened to a slab and to the other one, the movement of a slab relative to the next one will also lead at best to a deformation of the panel, at worst to a setback of a panel. The current European earthquake-resistance standards provide that a building must be able to withstand, without separation of its main elements, the moving by 4.5 cm of a slab relative to the next one.

The systems for fastening panels known so far do not permit to keep this constraint.

It is also observed in the field of building that it is often difficult to obtain elements of a structure such as beams or slabs that have perfectly rectilinear edges over large lengths. This is particularly true for elements of a concrete structure. Thus, it is common to observe, in the concrete shell, tolerances in the range of 1 to 3 cm, compared to a perfect straight line. Since the panels themselves are perfectly flat, it is often difficult to correctly fasten a panel to a slab edge with the known rigid fastening systems.

SUMMARY OF THE INVENTION

The invention provides a novel fastening system, which does not have all or part of the drawbacks of the known rigid fastening systems.

More specifically, the invention provides a new system for fastening a panel to an edge of an element of a supporting structure, element such as a beam or a slab, the system comprising:

- a clip comprising a shoe, the shoe having a U-shaped cross-section and having a first sidewall connected by a hinge-plate to a second sidewall; the hinge-plate has a slot extending along a longitudinal direction of the hinge-plate parallel to the first sidewall, and
- a connecting part comprising a flat part and a substantially cylindrically shaped stud extending along an axis of the stud perpendicular to a main plane of the flat part; said stud comprises a first end fastened to a bottom face of the flat part, said stud also comprises a head fastened to a second end of the stud: said head of the stud has for example a rectangular, oval or elongate cross-section in a plane perpendicular to the axis of the stud: a small dimension of the cross-section of the head is smaller than a width of the slot of the clip and a large dimension of the cross-section of the head is larger than the width of the slot of the clip.

The connecting part is aimed at being secured to the element of the structure, for example a slab or a beam, and the clip is aimed at being made integral above the panel to be fastened. As will be seen more clearly below in the examples, the connecting part is fastened to the clip by means of its stud. But the connecting part is not fastened rigidly to the clip, because the stud can slide in the orifice, along the longitudinal direction of the hinge-plate and along the axis of the stud. Since the foot of the panel is fastened rigidly, a non-rigid fastening at the top of the panel permits not to deform or break the panel and/or the connecting part in the event of a movement of the slab along the longitudinal direction of the hinge-plate, for example in case of an earthquake, or in case of a movement of the slab along the axis of the stud, for example in case of a change of the load of the slab.

The fastening system according to the invention thus namely permits to apply panels against the front of the main supporting structure made of wood, concrete or steel of a building. The fastening system ensures the adjustment of the panels in the three dimensions, in order to compensate for the defects or dimensional tolerances of the main supporting structure. The fastening system also permits to absorb the dimensional variations of the main supporting structure without generating mechanical stress and deformation damaging the panels of the lower or upper floors.

The connecting part can also comprise a flat fin fastened to the flat part, extending from an upper face of the flat part in a plane that is perpendicular to the main plane of the flat part; said fin comprises at least one fastening hole. The fin permits the positioning and the fastening of a second panel on top of a first panel held by the flat part.

The system according to the invention can further comprise a positioning bracket comprising a first wall and a second wall perpendicular to the first wall. The first wall of the bracket is aimed at resting against an upper face of the element of the structure and against the lower face of the flat part, and a sidewall of the clip being aimed at resting against the second wall of the bracket. The bracket can take up the defects of manufacturing of the slab or beam: it permits to have perfectly flat resting surfaces for the flat part and for the panel.

The system can also comprise a leveling wedge having a hole adapted to a diameter of the first end of the stud projecting at the upper face of the flat part of the connecting part. Said wedge is aimed at being positioned on the flat part of the connecting part and at being held in position by the first end of the stud. The wedge permits to have a perfectly horizontal plane for the positioning of a second panel above the panel held by the connecting part.

BRIEF DESCRIPTION OF THE DRAWINGS

The invention will be better understood and further features and advantages of the invention will become clear from the following description of exemplary fastening systems according to the invention. These examples are given in a non-restrictive way. The description should be read together with the fastened drawings, in which.

DETAILED DESCRIPTION OF THE DRAWINGS

The fastening system has been developed for the panels object of the patent FR2922565, formed of a stack of plies crossed at 90°, each ply being formed of strips of wood and filling strips (insulation, firewall, etc.) positioned between the strips of wood. The fastened figures thus show the use of the fastening system on such panels.

But the fastening system according to the invention can be used more generally for fastening any type of panel, for example, solid panels made of a single material.

As previously stated, the fastening system according to the invention permits to fasten a panel to an edge of an element of a supporting structure, for example a slab 100. The fastening system mainly comprises two elements; a clip 200 and a connection part 300.

Figure 1:
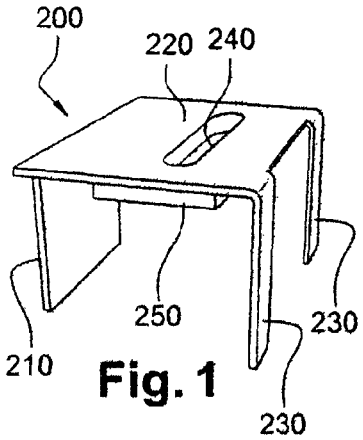
FIG. 1 is a perspective view of a clip of a fastening system according to the invention.
Figure 2:
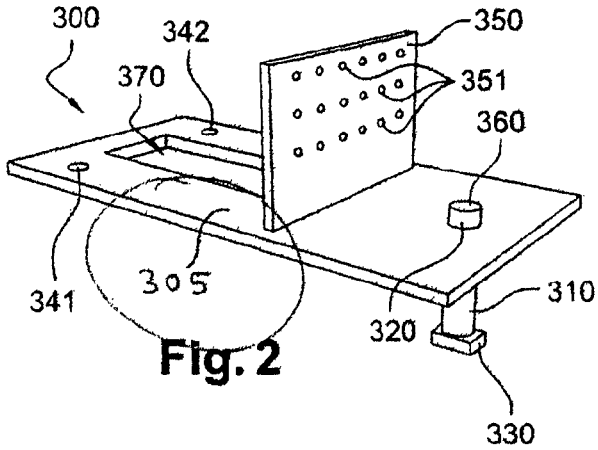
FIG. 2 is a perspective view of a connecting part of a fastening system according to the invention.
Figure 3:
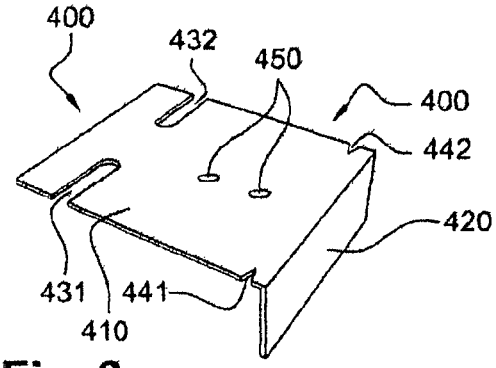
FIG. 3 is a perspective view of a bracket of a fastening system according to the invention.

The clip 200 comprises (FIG. 1) a shoe having a U-shaped cross-section. A first sidewall 210 is connected by means of a hinge-plate 220 to a second side wall 230. The hinge-plate has a slot 240 extending according to a longitudinal direction of the hinge-plate parallel to the first sidewall 210. The clip is adapted for being positioned on top of a panel (FIGS. 5 to 9).

In the example shown, the slot has an elongate shape. The first wall of the clip 210 is solid, planar, substantially rectangular. The second wall of the clip comprises two solid, planar wings, in the same plane, substantially rectangular and spaced apart from each other. The first wall 210 comprises at least one fastening hole. Likewise, each wing of the second wall comprises at least one fastening hole. The fastening holes permit to make the walls 210, 220 integral with the main faces of the panel using a fastening organ such as a screw or a nail, a threaded rod or a spindle, without using a tool for drilling the walls of the clip.

This embodiment of the clip is specific to the panel shown in the figures. It permits the sidewalls of the clip to rest on strips of wood of the panel (i.e. on the structuring portion of the panel), on strips that have different directions, and this without the need of cutting (and thus of weakening) a strip. Other embodiments of the clip can be contemplated, namely with two identical sidewalls, according to the choice solid, substantially rectangular walls, or walls having two wings.

In the example shown, the clip is made from a folded flat metallic part with a thickness of about 2 to 4 mm. The first wall 210 has a dimension of approximately 70 to 130 mm by 70 to 110 mm, each wing of the second wall 230 has a dimension of approximately 20 to 40 mm by 70 to 110 mm, the hinge-plate has a dimension of approximately 100 to 150 mm by 130 to 190 mm. These values show an order of magnitude of the dimensions of the parts of a system according to the invention, of course purely as an indication. These values depend, in practice, namely on the thickness of the panel, on its embodiment, on the desired mechanical strength, etc.

The clip 200 also includes a reinforcing part 250 comprising a slot of a shape and dimensions similar to those of the hinge-plate; said reinforcing part is fastened, for example welded, under the hinge-plate so that the slot of the hinge-plate and the slot of the reinforcing part coincide. The reinforcing part 250 improves the mechanical tearing strength of the hinge-plate.

The connecting part 300 comprises a flat part 305 and a stud 310 with a substantially cylindrical shape; the stud 310 extends at a base end of the flat part 305, according to an axis of the stud perpendicular to a main plane of the flat part; said stud 310 comprises a first end 320 fastened to a bottom face of the flat part; said stud 310 also comprises a head 330 fastened to a second end of the stud. The head of the stud has, in a plane perpendicular to the axis of the stud, a cross-section a small dimension of which is smaller than a width of the slot 240 of the clip 200 and whose large dimension is greater than the width slot 240 of the clip 200. These dimensions are important, since they permit the locking of the connecting part to the clip, as will be seen more clearly below.

In the example shown, the cross-section of the head of the stud has a rectangular shape: in a variant, said cross-section has an oval or elongate shape. The flat part of the connecting part is made of metal; it has a dimension of about 130 to 190 mm by 300 to 400 mm, and a thickness of about 6 to 10 mm. The stud has a length of about 40 to 80 mm and a diameter of about 14 to 19 mm. The dimensions of the flat part and the stud are chosen depending on the dimensions of the panel to be fastened, of the slab and the desired mechanical strength. The diameter of the stud is chosen equal or slightly smaller than the width of the slot 240. Thus, when the stud is positioned in the slot, the panel is immobilized in a horizontal plane. The length of the stud is chosen so as to permit, on the one hand, to take up the defects in thickness and/or positioning of the slab, which are commonly in the range of several millimeters to 2 to 4 cm, without damaging the panel the dimension of which is perfectly controlled from one panel to another and, on the other hand, to absorb an eventual bending of the slab due to a variation in load on the slab, which bending can reach from 1 to 2 cm.

The flat part of the connecting part also comprises, at a tip end, opposite to the base end, two fastening holes 341,342 permitting to make the connecting part 200 integral with the slab 100 by means of a fastening organ such as a screw, a stud, a threaded rod, etc., without using a tool for drilling the flat metallic part of the connecting part.

Figure 7:
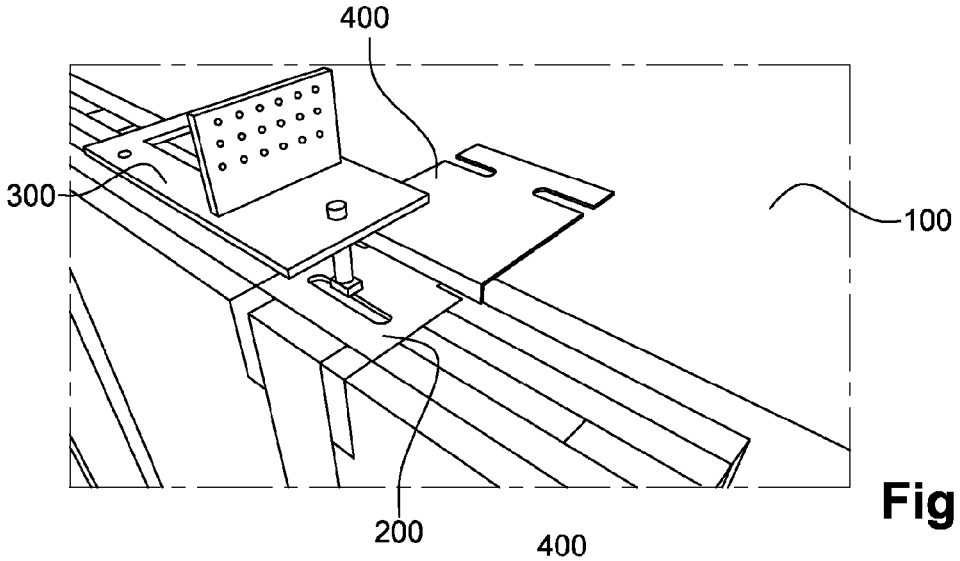
FIGS. 7 to 9 show the putting into position of the connecting part on the clip.150.
Figure 8:
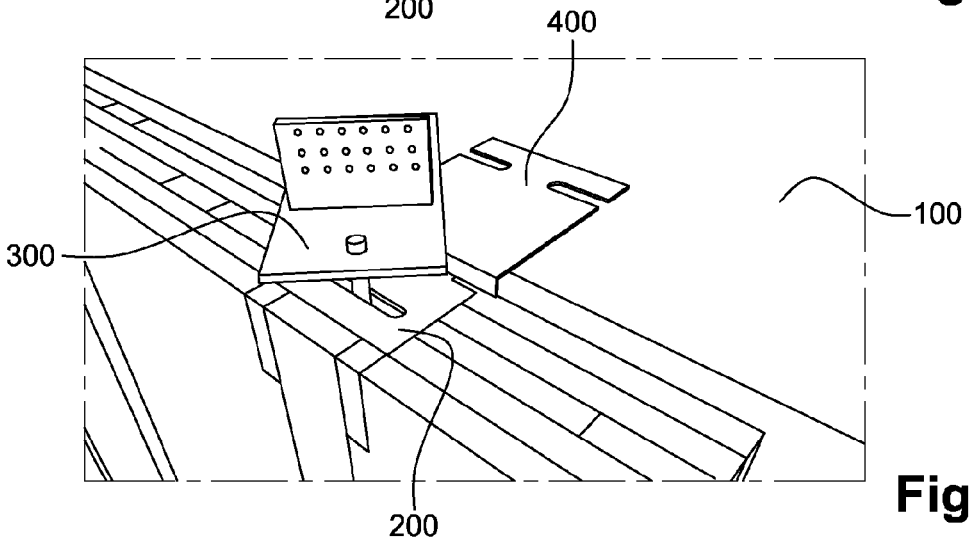
Figure 9:
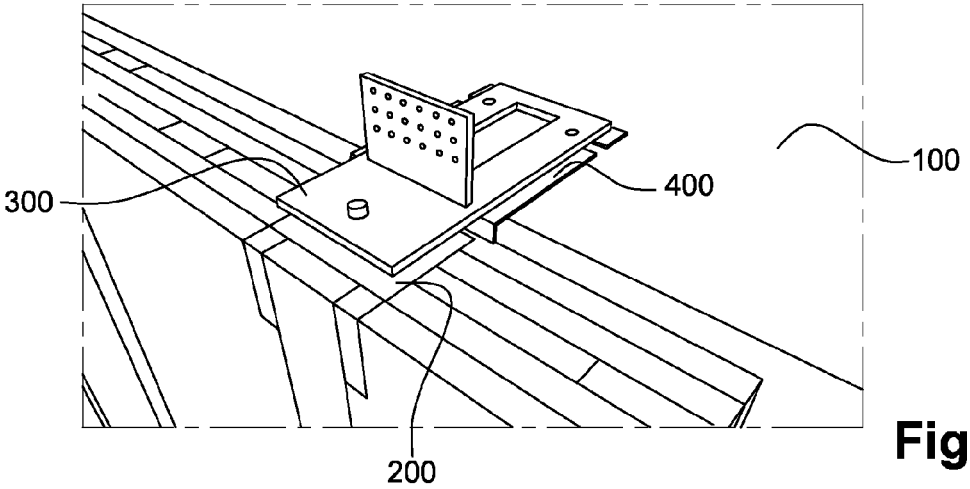

FIGS. 7 to 9 show how to position the connecting part 300 on the clip 200. The connecting part is positioned above the clip, so that the large dimension of the head of the stud extends into the main axis of the slot 240 of the clip (FIG. 7).

The connecting part is then lowered so that the head of the stud passes through the slot, then the connection part is rotated by 90° (FIG. 8, 9), then the connecting part is fastened by means of a fastening organ such as a screw, a stud, a threaded rod, etc., to the slab 100. The dimensions of the head of the stud are such that the head cannot project out of the slot 240, and therefore the panel cannot separate. Thus, even when the foot of the panel separates, the upper portion of the panel remains fastened to the slab. On the other hand, the connecting part is not rigidly secured to the clip, because the stud can slide in the slot, along the longitudinal direction of the hinge-plate and along the axis of the stud. Since the foot of the panel is rigidly fastened, a non-rigid fastening at the top of the panel permits not to deform or break the panel and/or the connecting part in the event of a movement of the slab 100 according to the longitudinal direction of the hinge-plate, for example in event of an earthquake, or by in the event of a movement of the slab along the axis of the stud, for example in case of a change in the load of the slab. The length of the slot 240 can be chosen depending on the earthquake-resistance standards, e.g., in the range from 7 to 11 cm.

The connecting part shown in the figures also comprises a flat fin 350 secured to the flat part of the connecting part 300; the fin extends from a top face of the flat part (face opposite the stud) in a plane that is perpendicular to the main plane of the flat part; said fin comprises at least one fastening hole. The fin serves for positioning and fastening the foot of a second panel that is placed above the first one. Of course, such a fin is not necessary when no panel should be fastened above the first panel. The fin is fastened to the flat part 305 so as to be in the same plane as the second wall 420 of the bracket 400. This permits to guarantee a perfect alignment of the panels above each other.

Finally, the flat part 305 of the connecting part 300 being shown comprises a recess 370 of a rectangular shape. This recess does not play any role in the fastening of the panel, it simply permits a saving of material and weight. In practice, the removed material corresponds to the reinforcement part 250 positioned under the hinge-plate 220 of the shoe of the clip.

In the examples shown, the system according to the invention also comprises a positioning bracket 400 comprising a first wall 410 and a second wall 420 perpendicular to the first wall; the first wall 410 of the bracket is aimed at resting on a top face of the slab 100 and on the bottom face of the flat part 305; the side wall 230 of the clip is aimed at resting on the second wall 420 of the bracket. The bracket allows to take up the eventual defects of the slab or the beam: the first wall 410 permits to have a perfectly flat bearing surface for the connecting part 300, which permits to firmly fasten the connecting to the slab or the beam without any risk of deforming same; the second wall 420 permits a perfectly flat resting of the panel, including in the case the edge of the slab has a defect of verticality or flatness. The bracket is simply placed on the edge of the slab; in practice it does not take up any mechanical force.

The first wall of the bracket also comprises at least one fastening hole, permitting, by means of a screw, to temporarily fasten the bracket while placing the connection part.

The first wall 410 of the bracket comprises, at one end, opposite the second wall of the bracket 420, two open cutouts 431, 432 ending at one lateral side of the first wall of the bracket. The cutouts permit the passing through of the organs (screw, stud, threaded rod, etc.) for fastening the connecting part to the slab.

The first wall of the bracket comprises two visual marks 441, 442 positioned on the lateral sides of the first wall 410 of the bracket, at a predetermined distance (e.g. 2 to 4 cm) of the second wall 420 of the bracket. During the placing of the bracket, these visual marks should be positioned on the top face of the slab or the beam; when these marks are outside the slab, it is considered that the defect of flatness and verticality of the flank of the slab 100 is too large, and that under these circumstances the fastening system according to the invention cannot be placed correctly. The visual marks thus inform about the mechanical limits of the bracket and secure its use. The visual marks can be of any type: notches, lines, markings, etc.

Figure 4:
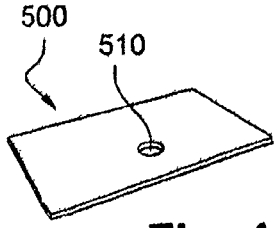
FIG. 4 is a perspective view of a wedge of a fastening system according to the invention.
Figure 5:
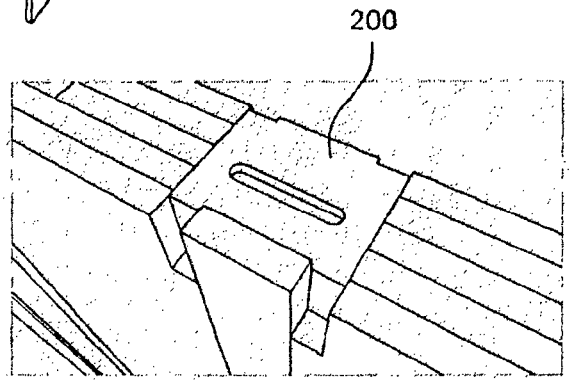
FIG. 5 shows a perspective view of a bracket in position on a panel.
Figure 6:
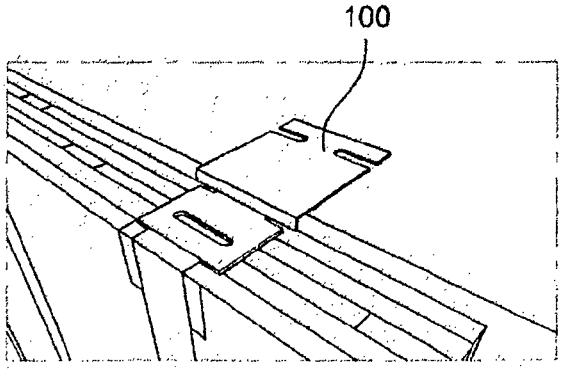
FIG. 6 shows a perspective view a bracket positioned on a slab, and a panel resting against the bracket.

Finally, in the examples shown, the system according to the invention also comprises a leveling wedge 500 (FIG. 4) having a hole 510 adapted to a diameter of the first end of the stud 320 protruding at the top face of the connecting part, in order to form a kind of pin; the wedge is aimed at being positioned on the connecting part and at being held in position in the plane of the connecting part by the first end of the stud. The wedge is practically a small flat connecting part with a thickness from some millimeters to 2 to 4 cm. The panels have a perfect dimension, corresponding for example to a floor height of a building. The wedge can take up the defects of thickness or positioning of the slab, which are commonly in the range from a few millimeters to 2 to 4 cm. The fastening systems are positioned for example every 1.5 to 2 m, over the full length of a building. The use of wedges permits to obtain a perfectly horizontal level over the entire length of the building in order to fasten panels as well as possible.

It should be noted that, in order to ensure the thermal and/or sound insulation of a wall formed of panels fastened by means of fastening systems according to the invention, it is provided to fill the space between two panels, the space between the second (vertical) wall 420 of the bracket and the edge of the slab or beam with a compressible insulating material.

NOMENCLATURE

100 slab
200 clip
210 first wall of the shoe of the clip
220 hinge-plate of the shoe of the clip
230 second wall of the shoe of the clip
240 slot of the hinge-plate
250 reinforcing part under the slot
300 connecting part
310 stud
320 first end of the stud forming a pin
330 head of the stud
341, 341 holes
350 fin
351 fastening holes of the fin
370 recess
400 bracket
410 first wall of the bracket
420 second wall of the bracket
431.432 cutouts
441, 442 visual marks
450 fastening holes of the bracket
500 wedge
510 hole

I claim:

1. A system for fastening a panel to an edge of an element of a supporting structure, the system comprising:

a clip comprising a shoe, said shoe having a U-shaped cross-section and being comprised of a first sidewall, a hinge-plate, and a second sidewall, said first sidewall connecting to said hinge-plate along a first sidewall edge, said hinge plate connecting to said second sidewall along a second sidewall edge, said hinge-plate having a top surface and a bottom surface, said hinge-plate having a slot extending across said hinge-plate and parallel to said first sidewall edge, said first sidewall extending downward from said bottom surface of said hinge-plate, said second sidewall extending downward from said bottom surface of said hinge-plate; and a connecting part comprising a flat part with an upper surface and a lower surface and a cylindrical stud with a first end and a second end, said cylindrical stud extending downward and perpendicular to said lower surface of said flat part, said first end being fastened to said flat part, said second end extending downward from said flat part, wherein said second end is comprised of a head in removeable friction-fit engagement with said slot of said top surface of said hinge-plate, said head having a cross-section with a first dimension smaller than said slot and a second dimension wider than said slot, wherein said connecting part has a first orientation corresponding to said first dimension of said cross-section of said head aligned so as to insert into said slot of said hinge-plate of said clip, said top surface of said hinge plate facing said lower surface of said flat part, wherein said connecting part has a second orientation corresponding to said second dimension of said cross-section of said head aligned so as to lock into said slot of said hinge-plate of said clip, said flat part being aligned on said hinge plate from said first sidewall to said second sidewall in said second orientation, and wherein said upper surface of said flat part has a tip end and a base end opposite said tip end, said cylindrical stud extending downward from said base end, said tip end having a plurality of fastening holes.

2. The system, according to claim 1, wherein said first sidewall is solid, flat, and rectangular.

3. The system, according to claim 1, wherein said second sidewall comprises two wing portions spaced apart from each other, each wing portion being solid, flat, and rectangular.

4. The system, according to claim 1, wherein said clip further comprises a reinforcing part with a reinforcing slot, said reinforcing part being fastened on said bottom surface of said hinge-plate, said reinforcing slot being aligned with said slot of said hinge-plate.

5. The system, according to claim 1, further comprising:

a clip fastening hole in at least one of a group consisting of said first sidewall, said second sidewall, or both.

6. The system, according to claim 1, wherein the connecting part comprises a flat fin fastened to said flat part, said flat fin extending perpendicular from said upper surface of said flat part, said flat fin having at least one fastening fin hole.

7. The system, according to claim 1, further comprising:

a positioning bracket comprising a first bracket wall and a second bracket wall, said second bracket wall being perpendicular to said first bracket wall at one end of said first bracket wall, said first bracket wall being parallel to said upper surface of said hinge-plate, said second bracket wall facing at least one of a group consisting of said first sidewall and said second sidewall.

8. The system, according to claim 7, wherein said first bracket wall has at least one open cutout on another end of said first bracket wall opposite said end connected to said second bracket wall, each open cutout extending to a lateral side of said first bracket wall.

9. The system, according to claim 7, wherein said first bracket wall has a visual mark positioned on a lateral side of said first bracket wall, said visual mark being set at a predetermined distance from said second bracket wall.

10. The system, according to claim 7, wherein said first bracket wall has at least one fastening bracket hole.

11. The system, according to claim 1, further comprising:

a leveling wedge having a leveling hole, said leveling wedge being removeably set between said upper surface of said hinge-plate and said lower surface of said flat part, said cylindrical stud being aligned with and insertable through said leveling hole.

* * * * *